US009370243B2

(12) United States Patent
Menard et al.

(10) Patent No.: US 9,370,243 B2
(45) Date of Patent: Jun. 21, 2016

(54) INTERLOCKING SHELVING AND STORAGE UNIT

(71) Applicant: Menard, Inc., Eau Claire, WI (US)

(72) Inventors: Charlie Menard, Eau Claire, WI (US); Branden Von Uhl, Eau Claire, WI (US)

(73) Assignee: Menard, Inc., Eau Claire, WI (US)

( * ) Notice: Subject to any disclaimer, the term of this patent is extended or adjusted under 35 U.S.C. 154(b) by 0 days.

(21) Appl. No.: 14/219,038

(22) Filed: Mar. 19, 2014

(65) Prior Publication Data

US 2015/0265047 A1 Sep. 24, 2015

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 47/04*** | (2006.01) |
| ***A47F 5/00*** | (2006.01) |
| ***A47F 5/11*** | (2006.01) |
| ***A47F 3/00*** | (2006.01) |

(52) U.S. Cl.

CPC ..... *A47B 47/042* (2013.01); *A47B 47/0075* (2013.01); *A47B 47/0091* (2013.01); *A47F 3/004* (2013.01); *A47F 5/00* (2013.01); *A47F 5/0025* (2013.01); *A47F 5/116* (2013.01); *A47B 2230/0092* (2013.01)

(58) Field of Classification Search

CPC ..... A47B 47/042; A47B 81/068; A47B 47/0075; A47B 47/0091; A47B 47/04; A47B 47/025; A47B 47/00; A47B 47/066; A47B 47/0058; A47B 87/00; A47B 87/007; A47B 96/00; A47B 96/02; A47B 96/04; A47B 2230/0092; A47F 5/0018; A47F 5/0025; A47F 5/0043; A47F 5/10; A47F 5/101; A47F 5/11; A47F 5/112; A47F 5/116

USPC ..... 211/186, 189, 134, 135, 188; 206/561; 220/507, 510, 529, 533, 541, 542, 220/552–554; 312/111, 107; 52/211, 79.7, 52/79.5

See application file for complete search history.

(56) References Cited

U.S. PATENT DOCUMENTS

| | | | | | |
|---|---|---|---|---|---|
| 2,854,724 | A | * | 10/1958 | Wuorio | 249/168 |
| 3,069,216 | A | * | 12/1962 | Vaeth | 312/195 |
| 3,612,289 | A | * | 10/1971 | Zink | 108/180 |
| 3,812,977 | A | * | 5/1974 | Glassman | 211/189 |
| 4,373,449 | A | * | 2/1983 | Klaus et al. | 108/60 |
| 4,395,955 | A | * | 8/1983 | Pfeifer | 108/61 |
| 4,832,421 | A | | 5/1989 | Shoffner et al. | |
| 5,170,892 | A | * | 12/1992 | Fromkin | 211/36 |
| 5,423,463 | A | * | 6/1995 | Weeks | 224/42.33 |
| 5,460,277 | A | * | 10/1995 | Silva | 211/71.01 |
| 5,855,175 | A | | 1/1999 | Forbes et al. | |
| 6,010,015 | A | * | 1/2000 | Lin | 211/40 |
| 6,174,116 | B1 | * | 1/2001 | Brand | 410/140 |
| 6,532,878 | B2 | | 3/2003 | Tidemann | |
| 6,595,378 | B2 | * | 7/2003 | Wang | 211/189 |
| 6,615,999 | B1 | * | 9/2003 | Culp | 211/186 |
| 6,845,871 | B1 | * | 1/2005 | Culp | 211/186 |

(Continued)

*Primary Examiner* — Jennifer E Novosad
(74) *Attorney, Agent, or Firm* — Merchant & Gould P.C.

(57) ABSTRACT

This disclosure describes a shelving unit including a plurality of panels. The plurality of panels each includes a first edge; a second edge opposite the first edge; and a plurality of slots located at the first edge. One or more of the plurality of slots becomes narrower as the plurality of slots extends from the first edge to a center of the plurality of panels. The narrowing of the plurality of slots pinches an adjoining panel when assembled together to provide a secure joint.

18 Claims, 8 Drawing Sheets

(56) References Cited

U.S. PATENT DOCUMENTS

| | | | | |
|---|---|---|---|---|
| 7,114,300 | B1 * | 10/2006 | Culp | 52/211 |
| 7,856,772 | B1 * | 12/2010 | Culp et al. | 52/211 |
| 8,458,980 | B2 * | 6/2013 | Ivanov | 52/668 |
| 8,662,326 | B2 * | 3/2014 | Brick | 211/186 |
| 2004/0108290 | A1 * | 6/2004 | Davis | 211/187 |
| 2009/0066140 | A1 * | 3/2009 | Berent et al. | 297/440.13 |
| 2009/0309464 | A1 * | 12/2009 | Schwartz | 312/111 |
| 2014/0263130 | A1 * | 9/2014 | Davis | 211/182 |

* cited by examiner

INTERLOCKING SHELVING AND STORAGE UNIT

BACKGROUND

Storage units, such as book cases, cubby hole boxes or cubbies, and cabinets or lockers have been used to store articles of clothing, handbags, shoes, kid toys etc. Most times the storage units are sold in an unassembled state. Assembly of storage units often requires the use of tools, such as hammers, screwdrivers, or pliers. These tools can be used to assemble and disassemble the storage unit. Hardware fasteners are sometimes required to assemble the storage units. There are several disadvantages when assembling a storage unit as described above. One disadvantage is that installation and/or removal using tools can be slow and cumbersome and tools can easily be misplaced. Another disadvantage is the encumbering and confusing instructions that may accompany the assembly. Another disadvantage is the risk of injury presented when using tools.

SUMMARY

This disclosure describes a shelving unit including a plurality of panels. The plurality of panels each includes a first edge; a second edge opposite the first edge; and a plurality of slots located at the first edge. One or more of the plurality of slots becomes narrower as the plurality of slots extends from the first edge to a center of the plurality of panels. The narrowing of the plurality of slots pinches an adjoining panel when assembled together to provide a secure joint.

Another aspect of the disclosure relates to a plurality of elongated planar members for a shelving unit. The elongated planar members each have a first edge and an opposing second edge and a plurality of slots located at the first edge of the elongated planar members. One or more of the plurality of slots becomes narrower as the plurality of slots extends from the first edge to a center of the plurality of elongated planar members. The plurality of elongated planar members are assembled together to form a shelving unit and narrowing of the plurality of slots pinches an adjoining panel to provide a secure joint.

Still another aspect of the disclosure relates to a shelving unit including a plurality of panels. Each of the plurality of panels includes a first edge; a second edge opposite the first edge; a plurality of slots located at the first edge and separated by a gap. The plurality of slots terminates at a center of the plurality of panels. The plurality of panels can be assembled together at the plurality of slots to form the shelving unit. The shelving unit defines openings and a cubby can be positioned within the openings. One or more of the plurality of slots becomes narrower as the plurality of slots extends from the first edge to a center of the plurality of panels. The narrowing of the plurality of slots pinches an adjoining panel when assembled together to provide a secure joint. The cubby has a height substantially the same as the gap separating the plurality of slots in order to provide for a snug fit within the openings of the shelving unit.

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

DETAILED DESCRIPTION

As briefly described above, the present disclosure is directed to a shelving and storage unit for cubbies. The present disclosure describes the shelving and storage unit with reference to the attached figures. Numbers in the present disclosure refer to corresponding numbers in the attached figures. It will be appreciated that the figures are provided for purposes of explanation only and do not represent a sole way of implementing the technologies of the present disclosure.

Figure 1:
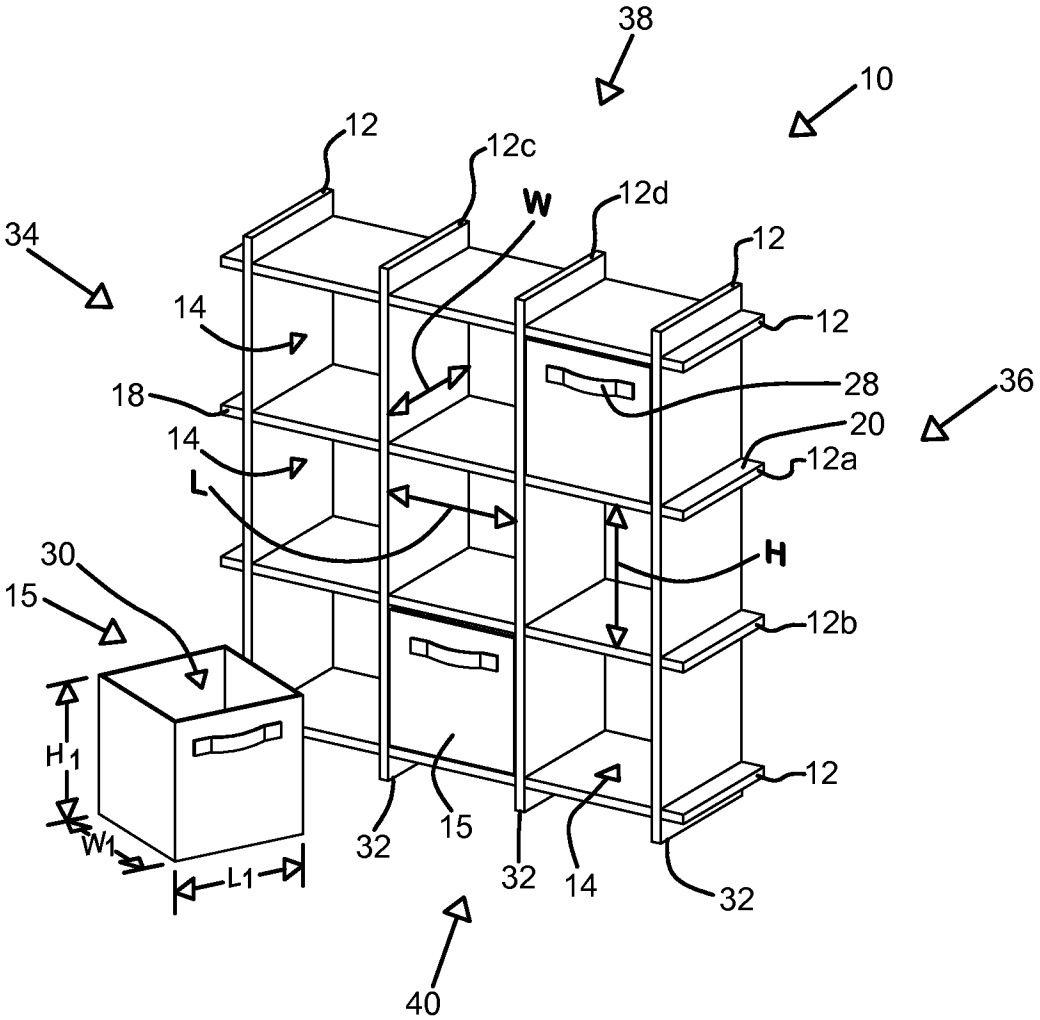
FIG. 1 illustrates a perspective view of an example shelving and storage unit including cubbies.

Referring now to FIG. 1, an example shelving and storage unit, generally designated 10, is shown. The shelving and storage unit 10 can be constructed of a plurality of panels 12 (e.g., elongated planar members) that can interlock together to define openings 14. The openings 14 can be of any size. For example, the shelving and storage unit 10 may be any size (small, medium, large, etc.) and the openings 14 can have a square shape.

In the depicted example, the shelving and storage unit 10 includes cubbies 15 that can be arranged in the openings 14 defined by the plurality of panels 12. The shelving and storage unit 10 can be assembled without the use of tools, thereby reducing the time required to assemble. The tool free method simplifies the assembly process which helps to better serve the end user or customer. In one example, the shelving and storage unit 10 can be assembled in minutes. The shelving and storage unit 10 is constructed by interlocking the plurality of panels 12 together. The plurality of panels 12 is illustrated and described in more detail with reference to FIGS. 3-7.

Figure 2:
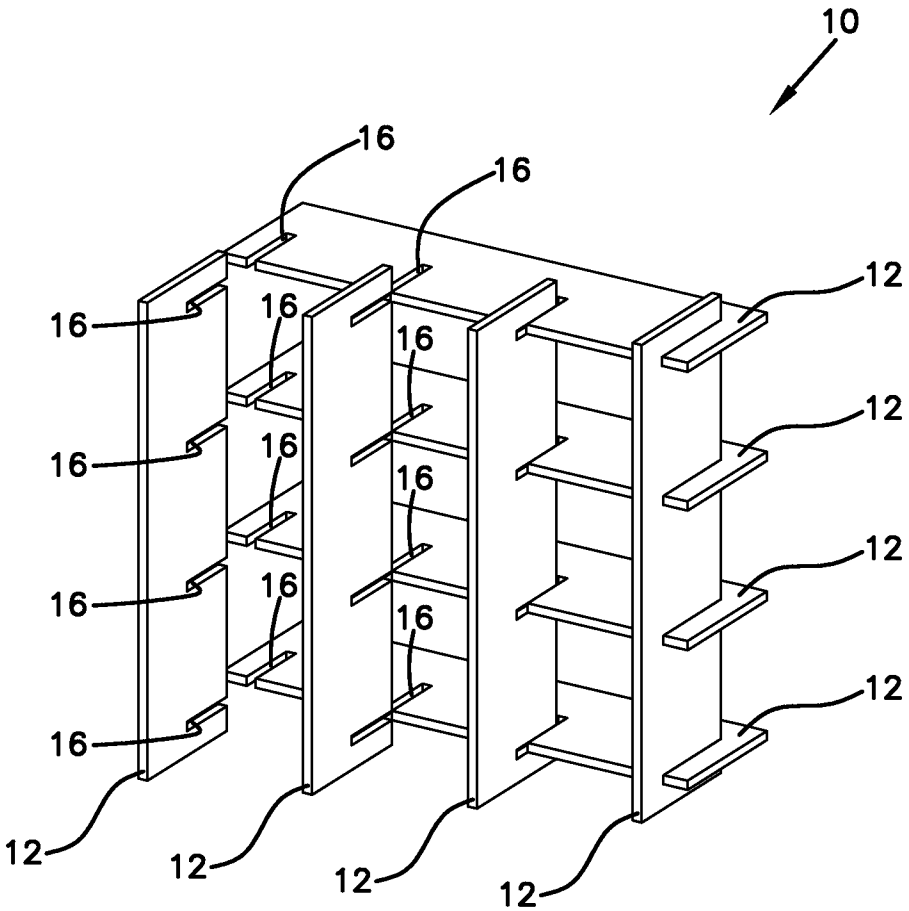
FIG. 2 illustrates a perspective view of the shelving and storage unit without the cubbies.

Referring to FIG. 2, the shelving and storage unit 10 is depicted with the plurality of panels 12 shown in a position prior to being interlocked together. The plurality of panels 12 each includes cooperating slots 16 for interlocking the plurality of panels 12 together. In one example, the plurality of panels 12 are positioned such that the cooperating slots 16 of one of the plurality of panels 12 is aligned with the cooperating slots 16 of another one of the plurality of panels 12. Once the cooperating slots 16 of the plurality of panels 12 are aligned, the plurality of panels 12 can be fitted together. The plurality of panels 12 can provide the customer or end user with the flexibility of laying out the shelving and storage unit 10 as desired in order to fit their needs. The shelving and storage unit 10 can be subject to change at any time by the customer or end user whenever needed. New panels can be designed and used to construct a new shelving and storage unit.

In the depicted example, the plurality of panels 12 is generally of a rectangular shape. It is to be understood that the shape of the panels may vary with other embodiments. The plurality of panels 12 can be made of any materials customarily used for shelving such as wood, fiberboard, or particle board. In some embodiments, the plurality of panels 12 may be made of a metal material or a plastic material.

Figure 3:
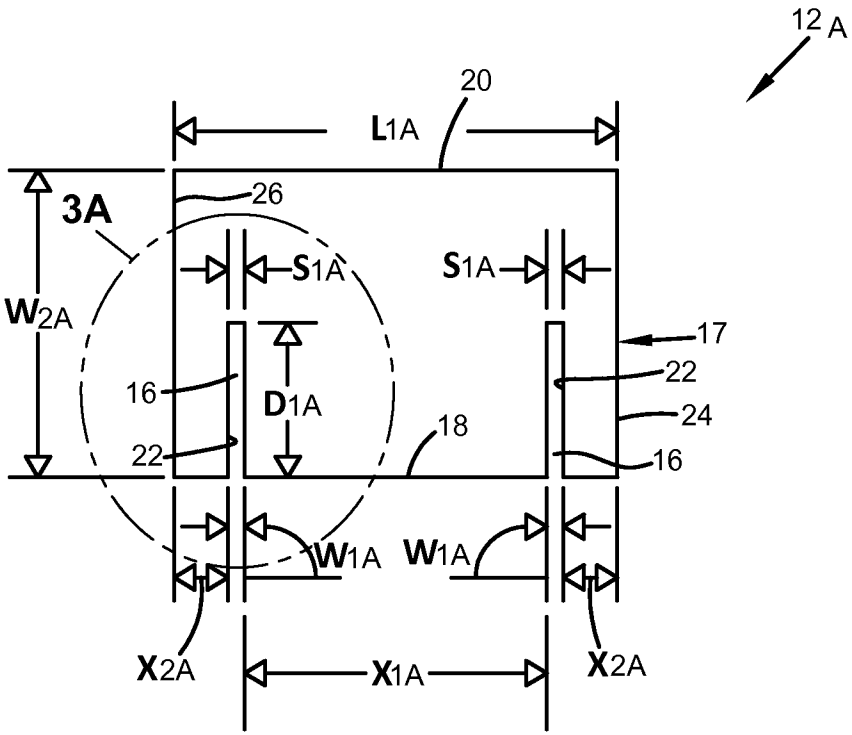
FIG. 3 illustrates a top plan view of a first example panel for use with the shelving and storage unit shown in FIG. 1.
Figure 3A:
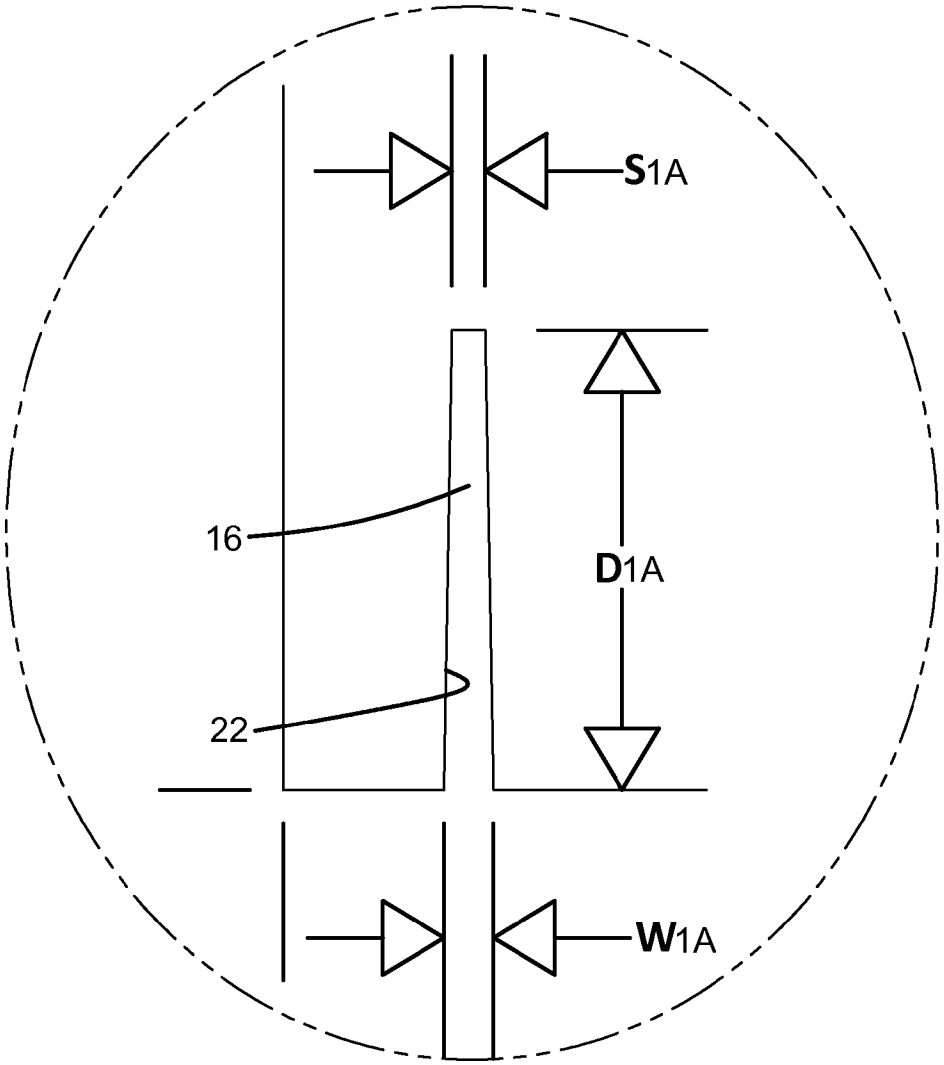
FIG. 3A illustrates an enlarged view of a portion of FIG. 3.

Referring to FIG. 3, a top plan view of a first panel $\mathbf{12}_A$ is shown.

The first panel $\mathbf{12}_A$ includes a first edge 18 and an opposing second edge 20. The first edge 18 defines a series of the slots 16. In the embodiment shown, the first panel $\mathbf{12}_A$ has two slots 16. In other embodiments, any number of slots 16 may be included. Each of the slots 16 can extend a distance $D_1$ into the first panel $\mathbf{12}_A$ from the first edge 18 toward the second edge 20. In the embodiment shown, the distance $D_{1A}$ is about 5 inches. In other embodiments, the distance $D_{1A}$ can vary to be longer or shorter. The slots 16 can be located at the first edge 18 of the first panel $\mathbf{12}_A$ and can be sized to receive the slots 16 of multiple first panels $\mathbf{12}_A$ to form the shelving and storage unit 10. In one embodiment, multiple first panels $\mathbf{12}_A$ can be assembled together at a substantially 90 degree angle. In other embodiments, the first panels $\mathbf{12}_A$ can be assembled together at an angle other than 90 degrees.

The slots 16 can be formed to have a slot width $W_1$ at the first edge 18 of the first panel $\mathbf{12}_A$ and a stop width $S_1$ adjacent to the opposing second edge 20 of the first panel $\mathbf{12}_A$. In the depicted example, the slots 16 terminate in the center 17 of the first panel $\mathbf{12}_A$. The slots 16 include an interior surface 22 defining a tapered shape that tapers inwardly toward the second edge 20. The interior surface 22 of the slots 16 can taper inwardly from the slot width $W_{1A}$ to the stop width $S_{1A}$ such that the stop width $S_{1A}$ is smaller than the slot width $W_{1A}$. The slots 16 become narrower as the slots 16 terminate in the center 17 of the first panel $\mathbf{12}_A$. The narrowing of the slots 16 'pinches' the adjoining first panel $\mathbf{12}_A$ when assembled together and thus provides a secure joint. It is to be understood that the adjoining panel can be a different size panel other than the first panel $\mathbf{12}_A$.

In one example, the stop width $S_{1A}$ of the slots 16 can be configured to prevent the first panels $\mathbf{12}_A$ from passing through the slots 16 when assembled together. In one example, the slot width $W_{1A}$ of the slots 16 can be sized to allow passage of the first panels $\mathbf{12}_A$ to secure or support the first panels $\mathbf{12}_A$ together by the configured tapering of the slots 16 from the slot width $W_{1A}$ to the stop width $S_{1A}$. Because of the taper configuration of the slots 16, the first panels $\mathbf{12}_A$ can be tightened together as the components are assembled. The tapering of the interior surface 22 of the slots 16 can help strengthen the joints of the first panels $\mathbf{12}_A$ when assembling the shelving and storage unit 10 such that the shelving and storage unit 10 is a stable, free-standing, self-supporting unit.

In one example, the slot width $W_{1A}$ can be about 0.63 inches wide. It is understood that the slot width $W_{1A}$ may vary in other embodiments. In certain examples, the stop width $S_{1A}$ can be about 0.62 inches. It is understood that the stop width $S_{1A}$ may vary in other embodiments. For example, gaps of differing sizes and differing tapers can be used.

In the depicted embodiment, the two slots 16 can be separated by a gap $X_{1A}$. In one example, the gap $X_{1A}$ can be about 11⅛ inches apart. It is to be understood that the gap $X_{1A}$ can vary with other embodiments. In certain examples, the slots 16 can be positioned a gap $X_{2A}$ from a top edge 24 of the first panel $\mathbf{12}_A$. Similarly, the slots 16 can be positioned a gap $X_{2A}$ from a bottom edge 26 of the first panel $\mathbf{12}_A$. It is to be understood that the gap $X_{2A}$ can vary with other embodiments.

The first panel $\mathbf{12}_A$ can have a width $W_{2A}$ that extends from the first edge 18 to the opposing second edge 20. In the depicted example, the width $W_{2A}$ of the first panel $\mathbf{12}_A$ is about 11¼ inches between the first edge 18 and the second edge 20. It is to be understood that the width $W_{2A}$ can vary with other embodiments. The first panel $\mathbf{12}_A$ can have a length $L_{1A}$ that extends from the top edge 24 to the bottom edge 26. In the depicted example, the length $L_{1A}$ is about 1 foot 4⅜ inches. It is to be understood that the length $L_{1A}$ can vary with other embodiments.

In one aspect, multiple first panels $\mathbf{12}_A$ can be interlocked together for constructing the shelving and storage unit 10. Each of the first panels $\mathbf{12}_A$ can be adjoined together by engaging the slots 16 of other first panels $\mathbf{12}_A$. The slots 16 in each of the first panels $\mathbf{12}_A$ are configured with a taper to tighten the first panels $\mathbf{12}_A$ together when assembled. The slots 16 help to strengthen the joints of the shelving and storage unit 10 thereby eliminating the need for tools.

Figure 4:
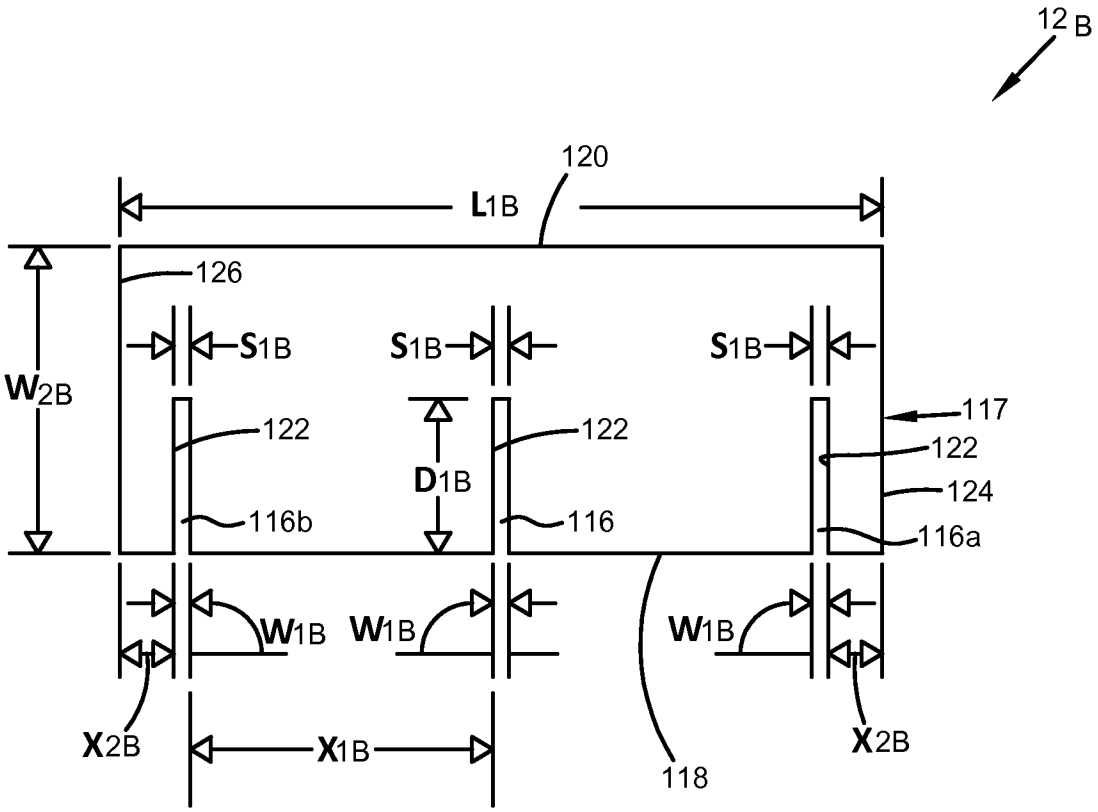
FIG. 4 illustrates a top plan view of a second example panel for use with the shelving and storage unit shown in FIG. 1.

Referring to FIG. 4, a top plan view of a second panel $\mathbf{12}_B$ is shown. Many of the possible aspects and features of the first panel $\mathbf{12}_A$ discussed above are applicable to the second panel $\mathbf{12}_B$ described below as well.

The second panel $\mathbf{12}_B$ includes a first edge 118 and an opposing second edge 120. The first edge 118 defines a series of the slots 116. In the embodiment shown, the second panel $\mathbf{12}_B$ has three slots 116. In other embodiments, any number of slots 116 may be included. Each of the slots 116 can extend a distance $D_{1B}$ into the second panel $\mathbf{12}_B$ from the first edge 118 toward the second edge 120. In the embodiment shown, the distance $D_{1B}$ is about 5 inches. In other embodiments, the distance $D_{1B}$ can vary to be longer or shorter. The slots 116 can be located at the first edge 118 of the second panel $\mathbf{12}_B$ and can be sized to receive the slots 116 of multiple second panels $\mathbf{12}_B$ to form the shelving and storage unit 10. In one embodiment, multiple second panels $\mathbf{12}_B$ can be assembled together at a substantially 90 degree angle. In other embodiments, the second panels $\mathbf{12}_B$ can be assembled together at an angle other than 90 degrees.

The slots 116 can be formed to have a slot width $W_{1B}$ at the first edge 118 of the second panel $\mathbf{12}_B$ and a stop width $S_{1B}$ adjacent to the opposing second edge 120 of the second panel $\mathbf{12}_B$. In the depicted example, the slots 116 terminate in the center 117 of the second panel $\mathbf{12}_B$. The slots 116 include an interior surface 122 defining a tapered shape that tapers inwardly toward the second edge 120. The interior surface 122 of the slots 116 can taper inwardly from the slot width $W_{1B}$ to the stop width $S_{1B}$ such that the stop width $S_{1B}$ is smaller than the slot width $W_{1B}$. The slots 116 become narrower as the slots 116 terminate in the center 117 of the second panel $\mathbf{12}_B$. The narrowing of the slots 116 'pinches' the adjoining second panel $\mathbf{12}_B$ when assembled together and thus provides a secure joint. It is to be understood that the adjoining panel can be the first panel $\mathbf{12}_A$ discussed above or other panels.

In one example, the stop width $S_{1B}$ of the slots 116 can be configured to prevent the second panels $\mathbf{12}_B$ from passing through the slots 116 when assembled together. In one example, the slot width $W_{1B}$ of the slots 116 can be sized to allow passage of the second panels $\mathbf{12}_B$ to secure or support the second panels $\mathbf{12}_B$ together by the configured tapering of the slots 116 from the slot width $W_{1B}$ to the stop width $S_{1B}$. Because of the taper configuration of the slots 116, the second panels $\mathbf{12}_B$ can be tightened together as the components are assembled. The tapering of the interior surface 122 of the slots 116 can help strengthen the joints of the second panels $\mathbf{12}_B$ when assembling the shelving and storage unit 10 such that the shelving and storage unit 10 is a stable, free-standing, self-supporting unit.

In one example, the slot width $W_{1B}$ can be about 0.63 inches wide. It is understood that the slot width $W_{1B}$ may vary in other embodiments. In certain examples, the stop width $S_{1B}$ can be about 0.62 inches. It is understood that the stop width $S_{1B}$ may vary in other embodiments.

In the depicted embodiment, the three slots 116 can be separated by a gap $X_{1B}$. In one example, the gap $X_{1B}$ can be about 11⅛ inches apart. It is to be understood that the gap $X_{1B}$ can vary with other embodiments. In certain examples, an outer slot 116*a* of the slots 116 can be positioned a gap $X_{2B}$ from a top edge 124 of the second panel $\mathbf{12}_B$. Similarly, an outer slot 116*b* of the slots 116 can be positioned a gap $X_{2B}$ from a bottom edge 126 of the second panel $\mathbf{12}_B$. It is to be understood that the gap $X_{2B}$ can vary with other embodiments.

The second panel $\mathbf{12}_B$ can have a width $W_{2B}$ that extends from the first edge 118 to the opposing second edge 120. In the depicted example, the width $W_{2B}$ of the second panel $\mathbf{12}_B$ is about 11¼ inches between the first edge 118 and the second edge 120. It is to be understood that the width $W_{2B}$ can vary with other embodiments. The second panel $\mathbf{12}_B$ can have a length $L_{1B}$ that extends from the top edge 124 to the bottom edge 126. In the depicted example, the length $L_{1B}$ is about 2 feet 4⅛ inches. It is to be understood that the length $L_{1B}$ can vary with other embodiments.

In one aspect, multiple second panels $\mathbf{12}_B$ can be interlocked together for constructing the shelving and storage unit 10. Each of the second panels $\mathbf{12}_B$ can be adjoined together by engaging the slots 116 of other second panels $\mathbf{12}_B$. The slots 116 in each of the second panels $\mathbf{12}_B$ are configured with a taper to tighten the second panels $\mathbf{12}_B$ together when assembled. The slots 116 help to strengthen the joints of the shelving and storage unit 10 thereby eliminating the need for tools.

Figure 5:
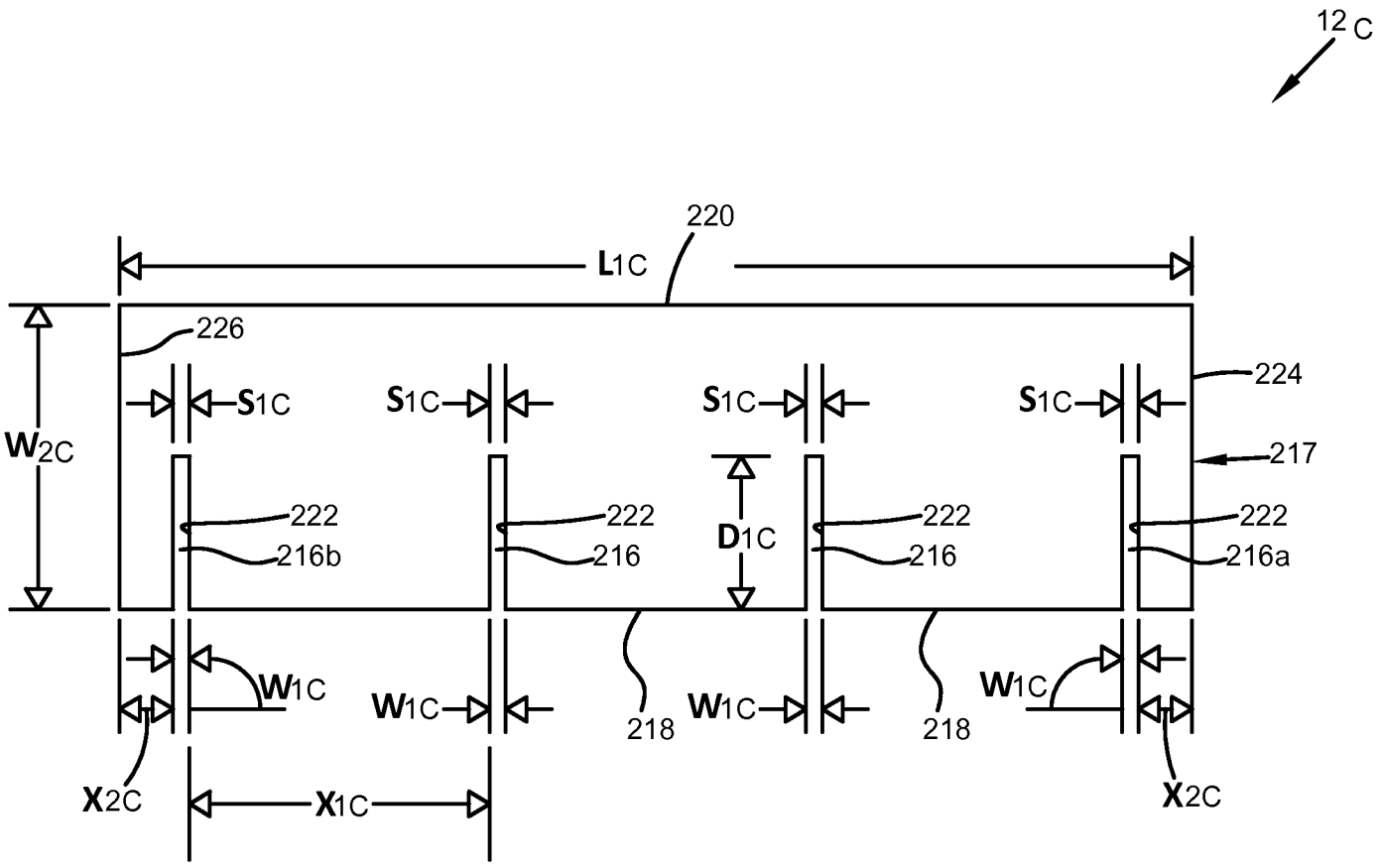
FIG. 5 illustrates a top plan view of a third example panel for use with the shelving and storage unit shown in FIG. 1.

Referring to FIG. 5, a top plan view of a third panel $\mathbf{12}_C$ is shown. Many of the possible aspects and features of the first and second panels $\mathbf{12}_A$, $\mathbf{12}_B$ discussed above are applicable to the third panel $\mathbf{12}_C$ described below as well.

The third panel $\mathbf{12}_C$ includes a first edge 218 and an opposing second edge 220. The first edge 218 defines a series of the slots 216. In the embodiment shown, the third panel $\mathbf{12}_C$ has four slots 216. In other embodiments, any number of slots 216 may be included. Each of the slots 216 can extend a distance $D_{1C}$ into the third panel $\mathbf{12}_C$ from the first edge 218 toward the second edge 220. In the embodiment shown, the distance $D_{1C}$ is about 5 inches. In other embodiments, the distance $D_{1C}$ can vary to be longer or shorter. The slots 216 can be located at the first edge 218 of the third panel $\mathbf{12}_C$ and can be sized to receive the slots 216 of multiple third panels $\mathbf{12}_C$ to form the shelving and storage unit 10. In one embodiment, multiple third panels $\mathbf{12}_C$ can be assembled together at a substantially 90 degree angle. In other embodiments, the third panels $\mathbf{12}_C$ can be assembled together at an angle other than 90 degrees.

The slots 216 can be formed to have a slot width $W_{1C}$ at the first edge 218 of the third panel $\mathbf{12}_C$ and a stop width $S_{1C}$ adjacent to the opposing second edge 220 of the third panel $\mathbf{12}_C$. In the depicted example, the slots 216 terminate in the center 217 of the third panel $\mathbf{12}_C$. The slots 216 include an interior surface 222 defining a tapered shape that tapers inwardly toward the second edge 220. The interior surface 222 of the slots 216 can taper inwardly from the slot width $W_{1C}$ to the stop width $S_{1C}$ such that the stop width $S_{1C}$ is smaller than the slot width $W_{1C}$. The slots 216 become narrower as the slots 216 terminate in the center 217 of the third panel $\mathbf{12}_C$. The narrowing of the slots 216 'pinches' the adjoining third panel $\mathbf{12}_C$ when assembled together and thus provides a secure joint. It is to be understood that the adjoining panel can be any of the first or second panels $\mathbf{12}_A$, $\mathbf{12}_B$ discussed above or other panels.

In one example, the stop width $S_{1C}$ of the slots 216 can be configured to prevent the third panels $\mathbf{12}_C$ from passing through the slots 216 when assembled together. In one example, the slot width $W_{1C}$ of the slots 216 can be sized to allow passage of the third panels $\mathbf{12}_C$ to secure or support the third panels $\mathbf{12}_C$ together by the configured tapering of the slots 216 from the slot width $W_{1C}$ to the stop width $S_{1C}$. Because of the taper configuration of the slots 216, the third panels $\mathbf{12}_C$ can be tightened together as the components are assembled. The tapering of the interior surface 222 of the slots 216 can help strengthen the joints of the third panels $\mathbf{12}_C$ when assembling the shelving and storage unit 10 such that the shelving and storage unit 10 is a stable, free-standing, self-supporting unit.

In one example, the slot width $W_{1C}$ can be about 0.63 inches wide. It is understood that the slot width $W_{1C}$ may vary in other embodiments. In certain examples, the stop width $S_{1C}$ can be about 0.62 inches. It is understood that the stop width $S_{1C}$ may vary in other embodiments.

In the depicted embodiment, the four slots 216 can be separated by a gap $X_{1C}$. In one example, the gap $X_{1C}$ can be about 11⅛ inches apart. It is to be understood that the gap $X_{1C}$ can vary with other embodiments. In certain examples, an outer slot 216*a* of the slots 216 can be positioned a gap $X_{2C}$ from a top edge 224 of the third panel $\mathbf{12}_C$. Similarly, an outer slot 216*b* of the slots 216 can be positioned a gap $X_{2C}$ from a bottom edge 226 of the third panel $\mathbf{12}_C$. It is to be understood that the gap $X_{2C}$ can vary with other embodiments.

The third panel $\mathbf{12}_C$ can have a width $W_{2C}$ that extends from the first edge 218 to the opposing second edge 220. In the depicted example, the width $W_{2C}$ of the third panel $\mathbf{12}_C$ is about 11¼ inches between the first edge 218 and the second edge 220. It is to be understood that the width $W_{2C}$ can vary with other embodiments. The third panel $\mathbf{12}_C$ can have a length $L_{1C}$ that extends from the top edge 224 to the bottom edge 226. In the depicted example, the length $L_{1C}$ is about 3 feet 3⅞ inches. It is to be understood that the length $L_{1C}$ can vary with other embodiments.

In one aspect, multiple third panels $\mathbf{12}_C$ can be interlocked together for constructing the shelving and storage unit 10. Each of the third panels $\mathbf{12}_C$ can be adjoined together by engaging the slots 216 of other third panels $\mathbf{12}_C$. The slots 216 in each of the third panels $\mathbf{12}_C$ are configured with a taper to tighten the third panels $\mathbf{12}_C$ together when assembled. The slots 216 help to strengthen the joints of the shelving and storage unit 10 thereby eliminating the need for tools.

Figure 6:
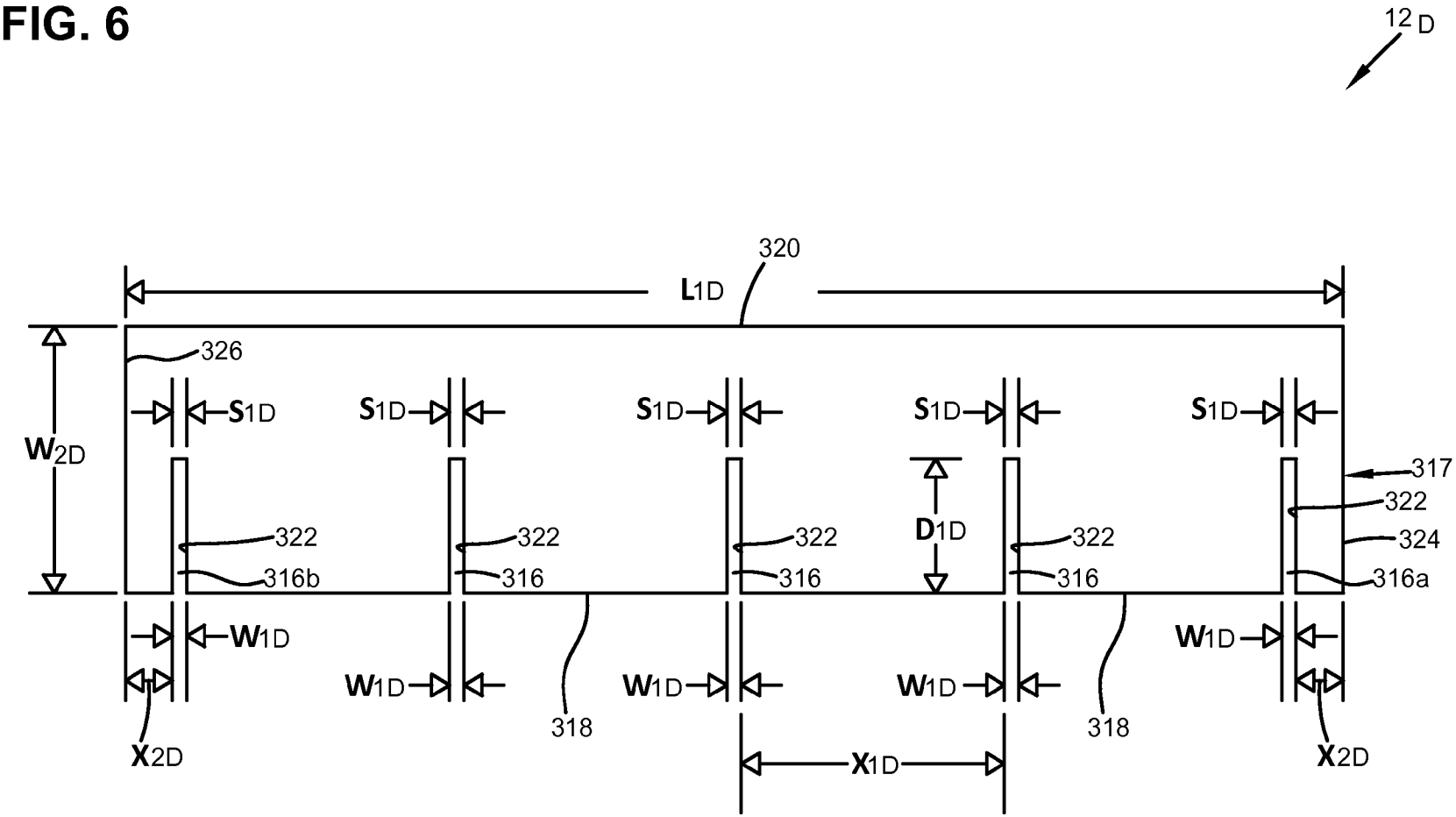
FIG. 6 illustrates a top plan view of a fourth example panel for use with the shelving and storage unit shown in FIG. 1.

Referring to FIG. 6, a top plan view of a fourth panel $\mathbf{12}_D$ is shown. Many of the possible aspects and features of the first, second, and third panels $\mathbf{12}_A$, $\mathbf{12}_B$, $\mathbf{12}_C$ discussed above are applicable to the fourth panel $\mathbf{12}_D$ described below as well.

The fourth panel $\mathbf{12}_D$ includes a first edge 318 and an opposing second edge 320. The first edge 318 defines a series of the slots 316. In the embodiment shown, the fourth panel $\mathbf{12}_D$ has five slots 316. In other embodiments, any number of slots 316 may be included. Each of the slots 316 can extend a distance $D_{1D}$ into the fourth panel $\mathbf{12}_B$ from the first edge 318 toward the second edge 320. In the embodiment shown, the distance $D_{1D}$ is about 5 inches. In other embodiments, the distance $D_{1D}$ can vary to be longer or shorter. The slots 316 can be located at the first edge 318 of the fourth panel $\mathbf{12}_D$ and can be sized to receive the slots 316 of multiple fourth panels $\mathbf{12}_D$ to form the shelving and storage unit 10. In one embodiment, multiple fourth panels $\mathbf{12}_D$ can be assembled together at a substantially 90 degree angle. In other embodiments, the fourth panels $\mathbf{12}_D$ can be assembled together at an angle other than 90 degrees.

The slots 316 can be formed to have a slot width $W_{1D}$ at the first edge 318 of the fourth panel $\mathbf{12}_D$ and a stop width $S_{1D}$ adjacent to the opposing second edge 320 of the fourth panel $12_D$. In the depicted example, the slots 316 terminate in the center 317 of the fourth panel $12_D$. The slots 316 include an interior surface 322 defining a tapered shape that tapers inwardly toward the second edge 320. The interior surface 322 of the slots 316 can taper inwardly from the slot width $W_{1D}$ to the stop width $S_{1D}$ such that the stop width $S_{1D}$ is smaller than the slot width $W_{1D}$. The slots 316 become narrower as the slots 316 terminate in the center 317 of the fourth panel $12_D$. The narrowing of the slots 316 'pinches' the adjoining fourth panel $12_D$ when assembled together and thus provides a secure joint. It is to be understood that the adjoining panel can be any of the first, second, or third panels $12_A$, $12_B$, $12_C$ discussed above or other panels.

In one example, the stop width $S_{1D}$ of the slots 316 can be configured to prevent the fourth panels $12_D$ from passing through the slots 316 when assembled together. In one example, the slot width $W_{1D}$ of the slots 316 can be sized to allow passage of the fourth panels $12_D$ to secure or support the fourth panels $12_D$ together by the configured tapering of the slots 316 from the slot width $W_{1D}$ to the stop width $S_{1D}$. Because of the taper configuration of the slots 316, the fourth panels $12_D$ can be tightened together as the components are assembled. The tapering of the interior surface 322 of the slots 316 can help strengthen the joints of the fourth panels $12_D$ when assembling the shelving and storage unit 10 such that the shelving and storage unit 10 is a stable, free-standing, self-supporting unit.

In one example, the slot width $W_{1D}$ can be about 0.63 inches wide. It is understood that the slot width $W_{1D}$ may vary in other embodiments. In certain examples, the stop width $S_{1D}$ can be about 0.62 inches. It is understood that the stop width $S_{1D}$ may vary in other embodiments.

In the depicted embodiment, the five slots 316 can be separated by a gap $X_{1D}$. In one example, the gap $X_{1D}$ can be about 11⅛ inches apart. It is to be understood that the gap $X_{1D}$ can vary with other embodiments. In certain examples, an outer slot 316*a* of the slots 316 can be positioned a gap $X_{2D}$ from a top edge 324 of the fourth panel $12_D$. Similarly, an outer slot 316*b* of the slots 316 can be positioned a gap $X_{2D}$ from a bottom edge 326 of the fourth panel $12_D$. It is to be understood that the gap $X_{2D}$ can vary with other embodiments.

The fourth panel $12_D$ can have a width $W_{2D}$ that extends from the first edge 318 to the opposing second edge 320. In the depicted example, the width $W_{2D}$ of the fourth panel $12_D$ is about 11¼ inches between the first edge 318 and the second edge 320. It is to be understood that the width $W_{2D}$ can vary with other embodiments. The fourth panel $12_D$ can have a length $L_{1D}$ that extends from the top edge 324 to the bottom edge 326. In the depicted example, the length $L_{1D}$ is about 4 feet 3⅝ inches. It is to be understood that the length $L_{1D}$ can vary with other embodiments.

In one aspect, multiple fourth panels $12_D$ can be interlocked together for constructing the shelving and storage unit 10. Each of the fourth panels $12_D$ can be adjoined together by engaging the slots 316 of other fourth panels $12_D$. The slots 316 in each of the fourth panels $12_D$ are configured with a taper to tighten the fourth panels $12_D$ together when assembled. The slots 316 help to strengthen the joints of the shelving and storage unit 10 thereby eliminating the need for tools.

Figure 7:
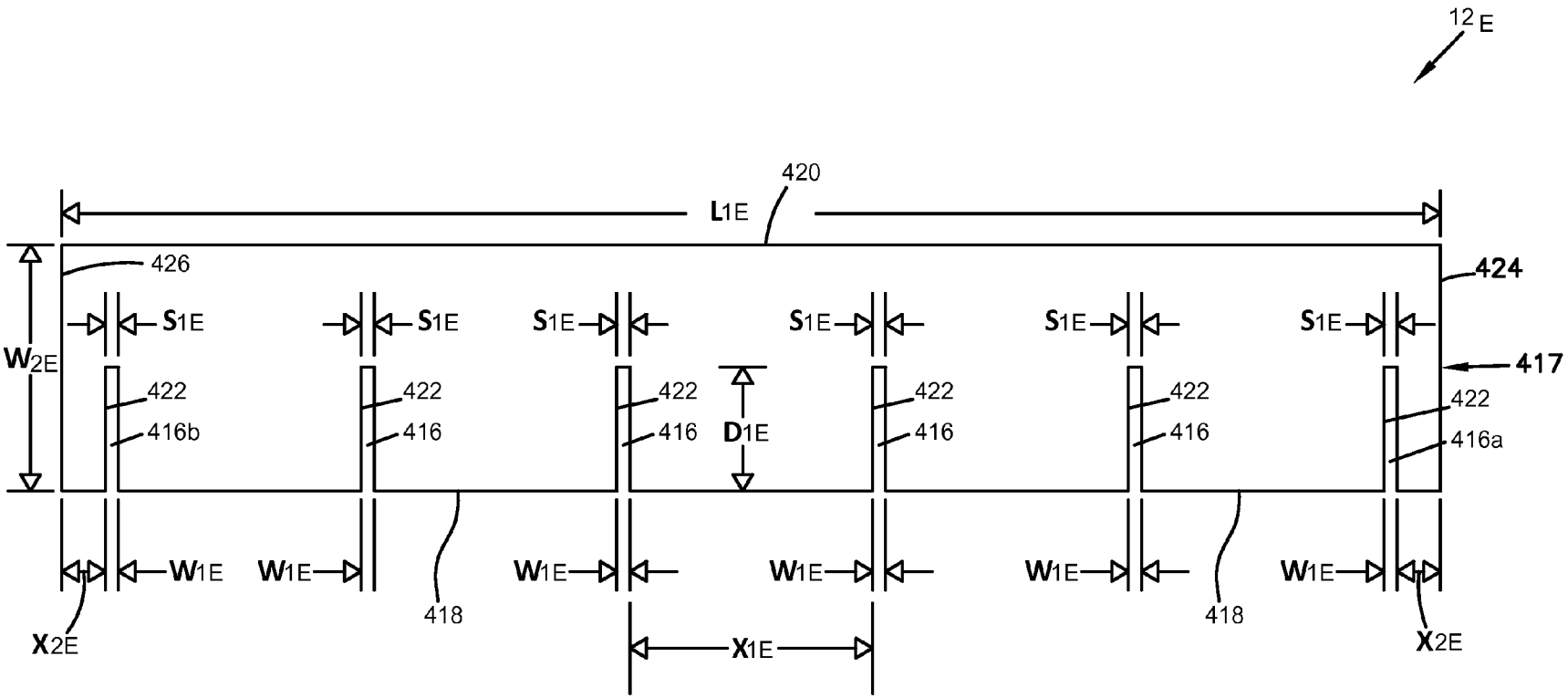
FIG. 7 illustrates a top plan view of a fifth example panel for use with the shelving and storage unit shown in FIG. 1.

Referring to FIG. 7, a top plan view of a fifth panel $12_E$ is shown. Many of the possible aspects and features of the first, second, third, and fourth panels $12_A$, $12_B$, $12_C$, $12_D$ discussed above are applicable to the fifth panel $12_E$ described below as well.

The fifth panel $12_E$ includes a first edge 418 and an opposing second edge 420. The first edge 418 defines a series of the slots 416. In the embodiment shown, the fifth panel $12_E$ has six slots 416. In other embodiments, any number of slots 416 may be included. Each of the slots 416 can extend a distance $D_{1E}$ into the fifth panel $12_E$ from the first edge 418 toward the second edge 420. In the embodiment shown, the distance $D_{1E}$ is about 5 inches. In other embodiments, the distance $D_{1E}$ can vary to be longer or shorter. The slots 416 can be located at the first edge 418 of the fifth panel $12_E$ and can be sized to receive the slots 416 of multiple fifth panels $12_E$ to form the shelving and storage unit 10. In one embodiment, multiple fifth panels $12_E$ can be assembled together at a substantially 90 degree angle. In other embodiments, the fifth panels $12_E$ can be assembled together at an angle other than 90 degrees.

The slots 416 can be formed to have a slot width $W_{1E}$ at the first edge 418 of the fifth panel $12_E$ and a stop width $S_{1E}$ adjacent to the opposing second edge 420 of the fifth panel $12_E$. In the depicted example, the slots 416 terminate in the center 417 of the fifth panel $12_E$. The slots 416 include an interior surface 422 defining a tapered shape that tapers inwardly toward the second edge 420. The interior surface 422 of the slots 416 can taper inwardly from the slot width $W_{1E}$ to the stop width $S_{1E}$ such that the stop width $S_{1E}$ is smaller than the slot width $W_{1E}$. The slots 416 become narrower as the slots 416 terminate in the center 417 of the fifth panel $12_E$. The narrowing of the slots 416 'pinches' the adjoining fifth panel $12_E$ when assembled together and thus provides a secure joint. It is to be understood that the adjoining panel can be any of the first, second, third, or fourth panels $12_A$, $12_B$, $12_C$, $12_D$ discussed above or other panels.

In one example, the stop width $S_{1E}$ of the slots 416 can be configured to prevent the fifth panels $12_E$ from passing through the slots 416 when assembled together. In one example, the slot width $W_{1E}$ of the slots 416 can be sized to allow passage of the fifth panels $12_E$ to secure or support the fifth panels $12_E$ together by the configured tapering of the slots 416 from the slot width $W_{1E}$ to the stop width $S_{1E}$. Because of the taper configuration of the slots 416, the fifth panels $12_E$ can be tightened together as the components are assembled. The tapering of the interior surface 422 of the slots 416 can help strengthen the joints of the fourth panels $12_E$ when assembling the shelving and storage unit 10 such that the shelving and storage unit 10 is a stable, free-standing, self-supporting unit.

In one example, the slot width $W_{1E}$ can be about 0.63 inches wide. It is understood that the slot width $W_{1E}$ may vary in other embodiments. In certain examples, the stop width $S_{1E}$ can be about 0.62 inches. It is understood that the stop width $S_{1E}$ may vary in other embodiments.

In the depicted embodiment, the six slots 416 can be separated by a gap $X_{1E}$. In one example, the gap $X_{1E}$ can be about 11⅛ inches apart. It is to be understood that the gap $X_{1E}$ can vary with other embodiments. In certain examples, an outer slot 416*a* of the slots 416 can be positioned a gap $X_{2E}$ from a top edge 424 of the fifth panel $12_E$. Similarly, an outer slot 416*b* of the slots 416 can be positioned a gap $X_{2E}$ from a bottom edge 426 of the fifth panel $12_E$. It is to be understood that the gap $X_{2E}$ can vary with other embodiments.

The fifth panel $12_E$ can have a width $W_{2E}$ that extends from the first edge 418 to the opposing second edge 420. In the depicted example, the width $W_{2E}$ of the fifth panel $12_E$ is about 11¼ inches between the first edge 418 and the second edge 420. It is to be understood that the width $W_{2E}$ can vary with other embodiments. The fifth panel $12_E$ can have a length $L_{1E}$ that extends from the top edge 424 to the bottom edge 426. In the depicted example, the length $L_{1E}$ is about 5 feet 3⅜ inches. It is to be understood that the length $L_{1E}$ can vary with other embodiments.

In one aspect, multiple fifth panels $12_E$ can be interlocked together for constructing the shelving and storage unit 10. Each of the fifth panels $12_E$ can be adjoined together by engaging the slots 416 of other fifth panels $12_E$. The slots 416 in each of the fifth panels $12_E$ are configured with a taper to tighten the fifth panels $12_E$ together when assembled. The slots 416 help to strengthen the joints of the shelving and storage unit 10 thereby eliminating the need for tools.

Any combination and any number of the first, second, third, fourth, and fifth panels $12_A$, $12_B$, $12_C$, $12_D$, $12_E$ can be assembled together. The wide variety of combinations that can be created allows the consumer or end user to customize the shelving and storage unit 10 as desired without the necessity of tools. For example, first panels $12_A$ may be assembled together with third panels $12_C$. In other examples, fourth panels $12_D$ may be assembled together with first panels $12_A$ and fifth panels $12_E$.

Referring again to FIG. 1, the openings 14 of the shelving and storage unit 10 can be defined by the plurality of panels 12. In one example, the openings 14 can have a height H that extends from a top panel 12*a* and a bottom panel 12*b*. In one example, the height H of the openings 14 can be defined by the gap $X_1$ (see FIG. 3) between the slots 16 of the panels. The openings 14 of the shelving and storage unit 10 can have a length L that extends between a left side panel 12*c* and a right side panel 12*d*. In certain examples, the length L can be defined by the gap $X_1$ between the slots 16 of the plurality of panels 12. In one example, the openings 14 of the shelving and storage unit 10 can have a width W (see FIG. 3) that extends from the first edge 18 and the second edge 20 of the plurality of panels 12. In certain examples, the width W can be defined by the width $W_2$ of the plurality of panels 12.

Still referring to FIG. 1, the cubbies 15 are generally of a square shape. It is to be understood that the cubbies 15 can vary in shape with other embodiments. For example, the cubbies 15 can have a rectangular, circle, triangle, oval, or other shape and combinations thereof. Once assembled, the shelving and storage unit 10 can store cubbies 15 in the openings 14 defined by the plurality of panels 12. In the depicted example, the cubbies 15 can be configured to fit snuggly within the openings 14 of the shelving and storage unit 10. In one example, the cubbies 15 can have a height $H_1$, a width $W_1$, and a length $L_1$. It is to be understood that the height $H_1$, width $W_1$, and length $L_1$ can vary with other embodiments.

In one example, the height $H_1$ of the cubbies 15 can be about 11 inches. In other examples, the height $H_1$ of the cubbies 15 can be approximately the same as the gap $X_1$ between the slots 16 of the plurality of panels 12. In other examples, the height $H_1$ of the cubbies 15 can be smaller than the gap $X_1$ between the slots 16 of the plurality of panels 12. In certain examples, the height $H_1$ of the cubbies 15 can be 4% smaller than the gap $X_1$ between the slots 16 of the plurality of panels 12.

In one example, the width $W_1$ of the cubbies 15 can be about 10.75 inches. In other examples, the width $W_1$ of the cubbies 15 can be approximately the same as the width $W_2$ of the plurality of panels 12. In one example, the width $W_1$ of the cubbies 15 can be smaller than the width $W_2$ the plurality of panels 12. In certain examples, the width $W_1$ of the cubbies 15 can be 4% smaller than the width $W_2$ the plurality of panels 12.

In one example, the length $L_1$ of the cubbies 15 can be about 10.75 inches. In other examples, the length $L_1$ of the cubbies 15 can be approximately the same as the gap $X_1$ between the slots 16 of the plurality of panels 12. In other examples, the length $L_1$ of the cubbies 15 can be smaller than the gap $X_1$ between the slots 16 of the plurality of panels 12. In certain examples, the length $L_1$ of the cubbies 15 can be 4% smaller than the gap $X_1$ between the slots 16 of the plurality of panels 12.

The cubbies 15 can be arranged in any fashion as desired by the consumer or end user. Any number of cubbies 15 may be used with the shelving and storage unit 10. The cubbies 15 can be made from a fabric material. In other examples, the cubbies 15 may be made from a plastic material. In certain examples, the cubbies 15 may be made from cardboard. It is to be understood that other materials, such as, but not limited to, metal, may be used to make the cubbies 15. In one example, the cubbies 15 can each include a handle 28 for placing and removing the cubbies 15 in and out of the shelving and storage unit 10. The cubbies 15 each include an opening 30 for storing items, such as, but not limited to, shoes, clothing, books, toys, etc. therein.

In some examples, the end portions of the fifth panel $12_E$ that form the gap $X_{2E}$ can extend beyond the shelving and storage unit 10 when assembled to become feet 32 (see FIG. 1) used to stand the shelving and storage unit 10. The feet 32 can extend from the shelving and storage unit 10 at a left side 34 (see FIG. 1), a right side 36 (see FIG. 1), a top side 38 (see FIG. 1), and a bottom side 40 (see FIG. 1). It is to be understood that the shelving and storage unit 10 can be positioned to stand as desired by the consumer or end user because of the multiple sides allowed to stand the shelving and storage unit 10.

While this invention has been particularly shown and described with references to preferred embodiments thereof, it will be understood by those skilled in the art that various changes in form and details may be made therein without departing from the scope of the invention encompassed by the appended claims. The drawings are not necessarily to scale, emphasis instead being placed upon illustrating the principles of the invention and other modifications within the scope. Any such modifications or variations that fall within the purview of this description are intended to be included therein as well. It is understood that the description herein is intended to be illustrative only and is not intended to be limitative.

What is claimed is:

1. A shelving unit comprising:

a plurality of panels, with each panel of the plurality of panels including:

a first edge;

a second edge opposite the first edge; and at least two slots located at the first edge;

wherein one or more of the at least two slots on the panel has an interior surface that continuously narrows inwardly all the way from the first edge to a center of the panel to form a tapered shape, the one or more of the at least two slots on the panel has a first width at the first edge and a second width at the center, the second width being smaller than the first width; and wherein a respective slot of the at least two slots of the panel pinches another panel of the plurality of panels when the another panel is introduced into the respective slot of the panel to form a secure joint.

2. The shelving unit according to claim 1, wherein the at least two slots terminate at the center of the panel.

3. The shelving unit according to claim 1, wherein each of the at least two slots is separated by a gap located at the first edge of the panel.

4. The shelving unit according to claim 3, wherein the plurality of panels defines one or more openings when assembled into the shelving unit.

5. The shelving unit according to claim 4, wherein a cubby is positioned within one of the one or more openings.

6. The shelving unit according to claim 5, wherein a height of the cubby is substantially the same as the gap separating the at least two slots located at the first edge of the panel.

7. The shelving unit according to claim 6, wherein the gap separating the at least two slots is about 11 inches.

8. The shelving unit according to claim 1, wherein the panel is substantially planar.

9. A plurality of elongated planar members for a shelving unit, the elongated planar members each having a first edge and an opposing second edge; and at least two slots located at the first edge of the elongated planar members;

wherein one or more of the at least two slots on each one of the plurality of elongated planar members has an interior surface that continuously narrows inwardly all the way from the first edge to a center of the plurality of elongated planar members to form a tapered shape;

wherein the plurality of elongated planar members are assembled together by introducing each of the plurality of elongated planar members into one of the at least two slots to form a shelving unit; and wherein each one of the at least two slots pinches one of the elongated planar members to form a secure joint.

10. The plurality of elongated planar members according to claim 9, wherein the at least two slots are separated by a gap located at the first edge of each one of the plurality of elongated planar members.

11. The plurality of elongated planar members according to claim 10, wherein the elongated planar members define one or more openings when assembled into the shelving unit.

12. The plurality of elongated planar members according to claim 11, wherein a cubby is positioned within one of the one or more openings.

13. The plurality of elongated planar members according to claim 12, wherein a height of the cubby is substantially the same as the gap separating the at least two slots located at the first edge of each one of the plurality of elongated planar members.

14. The plurality of elongated planar members according to claim 13, wherein the gap separating the at least two slots is about 11 inches.

15. A shelving unit comprising:

a plurality of panels, with each panel of the plurality of panels including:

a first edge;

a second edge opposite the first edge;

at least two slots located at the first edge and separated by a gap, the at least two slots terminating at a center of the panel, the plurality of panels being assembled together at the at least two slots to form the shelving unit, the shelving unit defining openings when assembled into the shelving unit; and a cubby positioned within one of the openings;

wherein one or more of the at least two slots on the panel has a tapered shape that continuously narrows inwardly all the way from the first edge to a center of the panel to thereby form a tapered shape;

wherein each one of the at least two slots pinches one of the plurality of panels to form a secure joint; and wherein the cubby has a height substantially the same as the gap separating the at least two slots to provide for a snug fit within the openings of the shelving unit.

16. The shelving unit according to claim 15, wherein the gap separating the at least two slots is about 11 inches.

17. The shelving unit according to claim 15, wherein each of the plurality of panels is substantially planar.

18. The shelving unit according to claim 15, wherein the openings of the shelving unit have a height and a length equal to the gap separating the at least two slots.

* * * * *